US008948432B2

(12) United States Patent
Tanaka et al.

(10) Patent No.: US 8,948,432 B2
(45) Date of Patent: Feb. 3, 2015

(54) MICROPHONE UNIT

(75) Inventors: Fuminori Tanaka, Osaka (JP); Ryusuke Horibe, Osaka (JP); Takeshi Inoda, Osaka (JP); Masatoshi Ono, Ibaraki (JP); Rikuo Takano, Ibaraki (JP); Toshimi Fukuoka, Kanagawa (JP)

(73) Assignees: Funai Electric Co., Ltd., Osaka (JP); Funai Electric Advanced Applied Technology Research Institute Inc., Osaka (JP)

( * ) Notice: Subject to any disclaimer, the term of this patent is extended or adjusted under 35 U.S.C. 154(b) by 0 days.

(21) Appl. No.: 13/131,447

(22) PCT Filed: Dec. 4, 2009

(86) PCT No.: PCT/JP2009/070388
§ 371 (c)(1),
(2), (4) Date: May 26, 2011

(87) PCT Pub. No.: WO2010/064704
PCT Pub. Date: Jun. 10, 2010

(65) Prior Publication Data

US 2011/0235841 A1 Sep. 29, 2011

(30) Foreign Application Priority Data

Dec. 5, 2008 (JP) ..... 2008-310506

(51) Int. Cl.
*H04R 1/00* (2006.01)
*H04R 1/38* (2006.01)
(Continued)

(52) U.S. Cl.
CPC ..... *H04R 1/38* (2013.01); *H04R 19/04* (2013.01); *H04R 2499/11* (2013.01)
USPC ..... 381/355; 381/357; 381/356

(58) Field of Classification Search
USPC ..... 381/357, 356
See application file for complete search history.

(56) References Cited

U.S. PATENT DOCUMENTS 4,843,628 A * 6/1989 Hofer ..... 381/345
5,272,758 A * 12/1993 Isogami et al. ..... 381/191
(Continued)

FOREIGN PATENT DOCUMENTS

JP 4-217199 8/1992
JP 8-340592 12/1996
(Continued)

OTHER PUBLICATIONS

Extended European Search Report dated May 8, 2012 for corresponding application No. 09830470.2.
(Continued)

*Primary Examiner* — Curtis Kuntz
*Assistant Examiner* — Thomas Maung
(74) *Attorney, Agent, or Firm* — Morgan, Lewis & Bockius LLP

(57) ABSTRACT

A microphone unit includes a case; a diaphragm arranged inside the case; and an electric circuit unit that processes an electric signal generated in accordance with vibration of the diaphragm. The case has a first sound introducing space that introduces a sound from outside of the case to a first surface of the diaphragm via a first sound hole; and a second sound introducing space that introduces a sound from outside of the case to a second diaphragm, via a second sound hole. A resonance frequency of the diaphragm is set in the range of ±4 kHz based on the resonance frequency of at least one of the first sound introducing space and the second sound introducing space.

4 Claims, 7 Drawing Sheets

(51) Int. Cl.
*H04R 19/04* (2006.01)
*H04R 1/04* (2006.01)

(56) References Cited

U.S. PATENT DOCUMENTS

| | | | | |
|---|---|---|---|---|
| 5,651,074 | A | 7/1997 | Baumhauer, Jr. et al. | |
| 2005/0163336 | A1* | 7/2005 | Hiramoto et al. | 381/369 |
| 2005/0190944 | A1 | 9/2005 | Akino et al. | |
| 2007/0189563 | A1 | 8/2007 | Sjursen et al. | |
| 2008/0247586 | A1* | 10/2008 | Takano et al. | 381/361 |
| 2008/0247587 | A1* | 10/2008 | Sato | 381/365 |

FOREIGN PATENT DOCUMENTS

| | | |
|---|---|---|
| JP | 2004-282449 | 10/2004 |
| JP | 2005-295278 A | 10/2005 |
| JP | 2008-258904 | 10/2008 |
| WO | 99/37122 | 7/1999 |

OTHER PUBLICATIONS

Office Action dated Jun. 9, 2014, issued by the Taiwanese Patent Office.

* cited by examiner

MICROPHONE UNIT

TECHNICAL FIELD

The present invention relates to a microphone unit for converting an input sound into an electric signal and specifically to the construction of the microphone unit which is formed such that a sound pressure is applied to both surfaces (front and rear surfaces) of a diaphragm and converts an input sound into an electric signal utilizing vibration of the diaphragm based on a sound pressure difference.

BACKGROUND ART

Conventionally, a microphone unit is provided in sound communication devices, such as mobile phones and transceivers, information processing systems, such as voice authentication systems, that utilize a technology for analyzing input voice, sound recording devices and the like. At the time of conversation by a mobile phone or the like, voice recognition and voice recording, it is preferable to pick up only a target voice (user's voice). Thus, there is an ongoing development of a microphone unit which accurately extracts a target voice and removes noise (background sounds, etc.) other than the target voice.

To provide a microphone unit with directivity can be cited as a technology for picking up only a target voice by removing noise in a use environment where noise is present. As an example of microphone units with directivity, a microphone unit which is formed such that a sound pressure is applied to both surfaces of a diaphragm and converts an input sound into an electric signal utilizing vibration of the diaphragm based on a sound pressure difference has been conventionally known (see, for example, patent literature 1).

CITATION LIST

Patent Literature

Patent literature 1:

Japanese Unexamined Patent Publication No. H04-217199

SUMMARY OF INVENTION

Technical Problem

The microphone unit formed such that a sound pressure is applied to both surfaces of the diaphragm and adapted to convert an input sound into an electric signal utilizing vibration of the diaphragm based on a sound pressure difference has a smaller displacement caused by the vibration of the diaphragm as compared with a microphone unit in which a diaphragm is vibrated by applying a sound pressure only to one surface of the diaphragm. Thus, in some cases, it is difficult for the above microphone unit formed such that a sound pressure is applied to both surfaces of the diaphragm to obtain a desired SNR (Signal to Noise Ratio), wherefore there has been a demand for an improvement to ensure a high SNR.

Accordingly, an object of the present invention is to provide a high-performance microphone unit which is formed such that a sound pressure is applied to both surfaces of a diaphragm, converts an input sound into an electric signal utilizing vibration of the diaphragm based on a sound pressure difference and can ensure a high SNR.

Solution to Problem

In order to accomplish the above object, the present invention is directed to a microphone unit, including a case; a diaphragm arranged inside the case; and an electric circuit unit that processes an electric signal generated in accordance with vibration of the diaphragm, wherein the case includes a first sound introducing space that introduces a sound from outside of the case to a first surface of the diaphragm via a first sound hole and a second sound introducing space that introduces a sound from outside of the case to a second surface, which is an opposite surface of the first surface of the diaphragm, via a second sound hole; and a resonance frequency of the diaphragm is set in the range of ±4 kHz based on a resonance frequency of at least one of the first and second sound introducing spaces.

The microphone unit of this construction is formed such that a sound pressure is applied to both surfaces of the diaphragm and converts an input sound into an electric signal utilizing vibration of the diaphragm based on a sound pressure difference. The microphone unit of such a construction needs increasing a difference between a sound pressure exerted on the diaphragm by a sound wave from the first sound hole and that exerted on the diaphragm by a sound wave from the second sound hole in view of an improvement of an SNR. In this case, volumes of the first and second sound introducing spaces have to be increased by increasing a distance between the first and second sound holes and the resonance frequencies of the first and second sound introducing spaces cannot be sufficiently high. In other words, resonance of the sound introducing spaces inevitably affects a frequency characteristic of the microphone unit in a use frequency band of the microphone unit. In this construction, the resonance frequency of the diaphragm is reduced toward those of the sound introducing spaces with an idea contrary to a conventional idea, taking advantage of the fact that resonance of the sound introducing spaces inevitably affects the frequency characteristic of the microphone unit. Thus, according to this construction, it is possible to increase sensitivity by reducing the stiffness of the diaphragm and provide a high-performance microphone unit capable of ensuring a high SNR.

In the microphone unit of the above construction, it is preferable that the first and second sound holes are formed in the same surface, and a distance between the centers of the first and second sound holes is not less than 4 mm and not more than 6 mm. By this construction, it is possible to sufficiently ensure the above sound pressure difference and provide a microphone unit capable of ensuring a high SNR by suppressing an influence by a phase distortion.

In the microphone unit of the above construction, the resonance frequencies of the first and second sound introducing spaces are preferably substantially equal. By this construction, a microphone unit with a high SNR can be more easily obtained.

In the microphone unit of the above construction, the resonance frequency of at least one of the first and second sound introducing spaces is preferably not less than 10 kHz and not more than 12 kHz. This construction is preferable since an adverse effect exerted by the resonance of the sound introducing spaces on the frequency characteristic of the microphone unit is maximally suppressed.

In the microphone unit of the above construction, the resonance frequency of the diaphragm may be set substantially equal to that of at least one of the first and second sound introducing spaces.

Advantageous Effects of Invention

The present invention provides a high-performance microphone unit which is formed such that a sound pressure is applied to both surfaces of a diaphragm and converts an input sound into an electric signal utilizing vibration of the diaphragm based on a sound pressure difference, and further ensures a high SNR.

EMBODIMENT OF THE INVENTION

Hereinafter, an embodiment of a microphone unit according to the present invention is described in detail with reference to the drawings.

Figure 1:
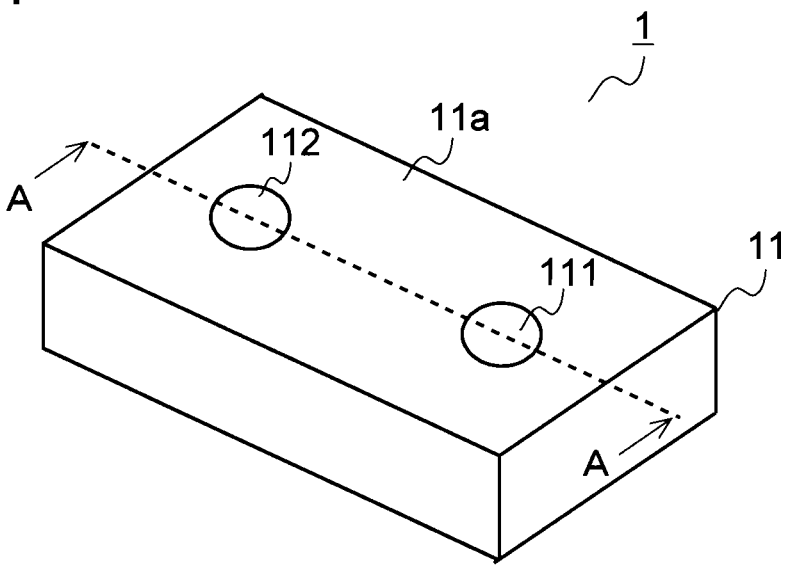
FIG. 1 is a schematic perspective view showing the construction of a microphone unit of this embodiment.
Figure 2:
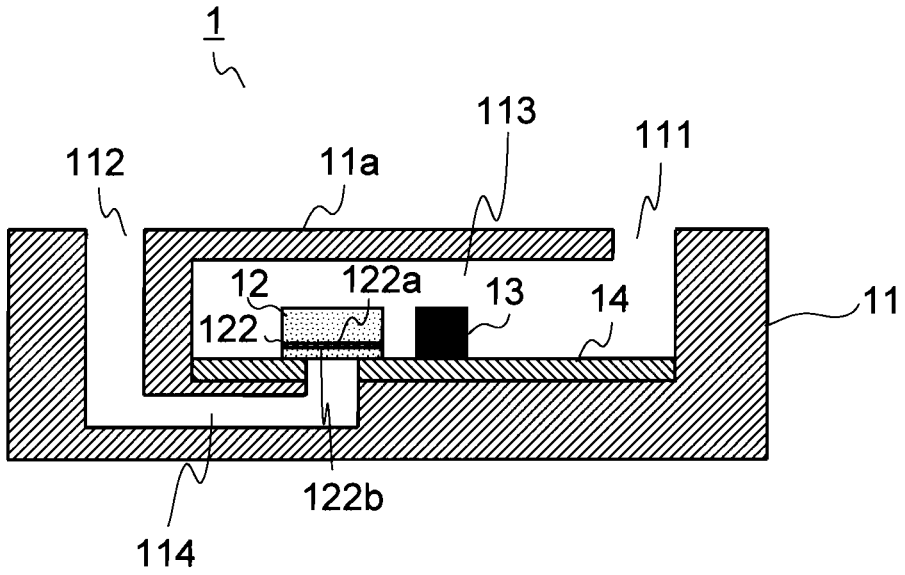
FIG. 2 is a schematic sectional view at a position A-A of FIG. 1.

FIG. 1 is a schematic perspective view showing the construction of a microphone unit of this embodiment. FIG. 2 is a schematic sectional view at a position A-A of FIG. 1. As shown in FIGS. 1 and 2, a microphone unit 1 of this embodiment includes a case 11, a MEMS (Micro Electro Mechanical System) chip 12, an ASIC (Application Specific Integrated Circuit) 13 and a circuit board 14.

The case 11 is substantially in the form of a rectangular parallelepiped and houses the MEMS chip 12 including a vibrating membrane (diaphragm) 122, the ASIC 13 and the circuit board 14 inside. Note that the outer shape of the case 11 is not limited to that of this embodiment and may be, for example, a cubic shape. Further, this outer shape is not limited to a hexahedron such as a rectangular parallelepiped or a cube and may be a polyhedral structure other than hexahedrons or a structure other than polyhedrons (e.g. a spherical structure or a semispherical structure).

As shown in FIGS. 1 and 2, a first sound introducing space 113 and a second sound introducing space 114 are formed in the case 11. The first and second sound introducing spaces 113, 114 are divided by the vibrating membrane 122 of the MEMS chip 12 to be described in detail later. In other words, the first sound introducing space 113 is in contact with an upper surface (first surface) 122*a* of the vibrating membrane 122 and the second sound introducing space 114 is in contact with a lower surface (second surface) 122*b* of the vibrating membrane 122.

A first sound hole 111 and a second sound hole 112 substantially circular in plan view are formed in an upper surface 11*a* of the case 11. The first sound hole 111 communicates with the first sound introducing space 113, whereby the first sound introducing space 113 and an external space of the case 11 communicate. In other words, a sound from outside of the case 11 is introduced to the upper surface 122*a* of the vibrating membrane 122 by the first sound introducing space 113 via the first sound hole 111.

Further, the second sound hole 112 communicates with the second sound introducing space 114, whereby the second sound introducing space 114 and the external space of the case 11 communicate. In other words, a sound from outside of the case 11 is introduced to the lower surface 122*b* of the vibrating membrane 122 by the second sound introducing space 114 via the second sound hole 112. A distance from the first sound hole 111 to the diaphragm 122 via the first sound introducing space 113 and that from the second sound hole 112 to the diaphragm 122 via the second sound introducing space 114 are set to be equal.

Note that a distance between the centers of the first and second sound holes 111, 112 is preferably about 4 to 6 mm, more preferably about 5 mm. By this construction, a sufficient difference between a sound pressure of a sound wave reaching the upper surface 122*a* of the diaphragm 122 via the first sound introducing space 113 and that of a sound wave reaching the lower surface 122*b* of the diaphragm 122 via the second sound introducing space 114 can be ensured and an influence by a phase distortion can also be suppressed.

Although the first and second sound holes 111, 112 are substantially circular in plan view in this embodiment, their shapes are not limited thereto but they may have a shape other than a circular shape, for example, a rectangular shape or the like. Further, although one first sound hole 111 and one second sound hole 112 are provided in this embodiment, the number of first sound hole 111 and second sound hole 112 may be plural without being limited to this configuration.

Further, although the first and second sound holes 111, 112 are formed in the same surface of the case 11 in this embodiment, these may be formed in different surfaces, e.g. adjacent surfaces or opposite surfaces without being limited to this configuration. However, to form the two sound holes 111, 112 in the same surface of the case 11 as in this embodiment is more preferable in preventing a sound path in a voice input device (e.g. mobile phone) mounted with the microphone unit 1 of this embodiment from becoming complicated.

Figure 3:
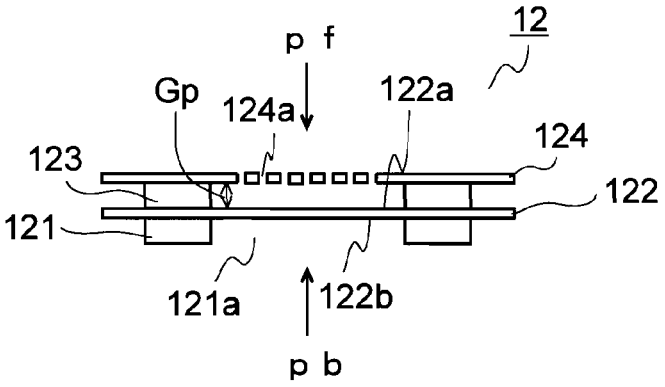
FIG. 3 is a schematic sectional view showing the configuration of a MEMS chip included in the microphone unit of this embodiment.

FIG. 3 is a schematic sectional view showing the configuration of the MEMS chip 12 included in the microphone unit 1 of this embodiment. As shown in FIG. 3, the MEMS chip 12 includes an insulating base board 121, the vibrating membrane 122, an insulating film 123 and a fixed electrode 124 and forms a condenser microphone. Note that this MEMS chip 12 is manufactured using a semiconductor manufacturing technology.

The base board 121 is formed with an opening 121*a*, which is, for example, circular in plan view, whereby a sound wave coming from a side below the vibrating membrane 122 reaches the vibrating membrane 122. The vibrating membrane 122 formed on the base board 121 is a thin membrane that vibrates (vertically vibrates) upon receiving a sound wave, is electrically conductive, and forms one end of electrodes.

The fixed electrode 124 is arranged to face the vibrating membrane 122 via the insulating film 123. Thus, the vibrating membrane 122 and the fixed electrode 124 form a capacitance. Note that the fixed electrode 124 is formed with a plurality of sound holes 124*a* to enable passage of a sound wave, so that a sound wave coming from a side above the vibrating membrane 122 reaches the vibrating membrane 122.

In such a MEMS chip 12, when a sound wave is incident on the MEMS chip 12, a sound pressure pf and a sound pressure pb are applied to the upper surface 122*a* and the lower surface 122*b* of the vibrating membrane 122, respectively. As a result, the vibrating membrane 122 vibrates according to a difference between the sound pressures pf and pb and a gap Gp between the vibrating membrane 122 and the fixed electrode 124 changes to change an electrostatic capacitance between the vibrating membrane 122 and the fixed electrode 124. In other words, the incident sound wave can be extracted as an electric signal by the MEMS chip 12 that functions as the condenser microphone.

Although the vibrating membrane 122 is located below the fixed electrode 124 in this embodiment, a reverse relationship (relationship, in which the vibrating membrane is arranged at an upper side and the fixed electrode is arranged at a lower side) may be employed.

Figure 4:
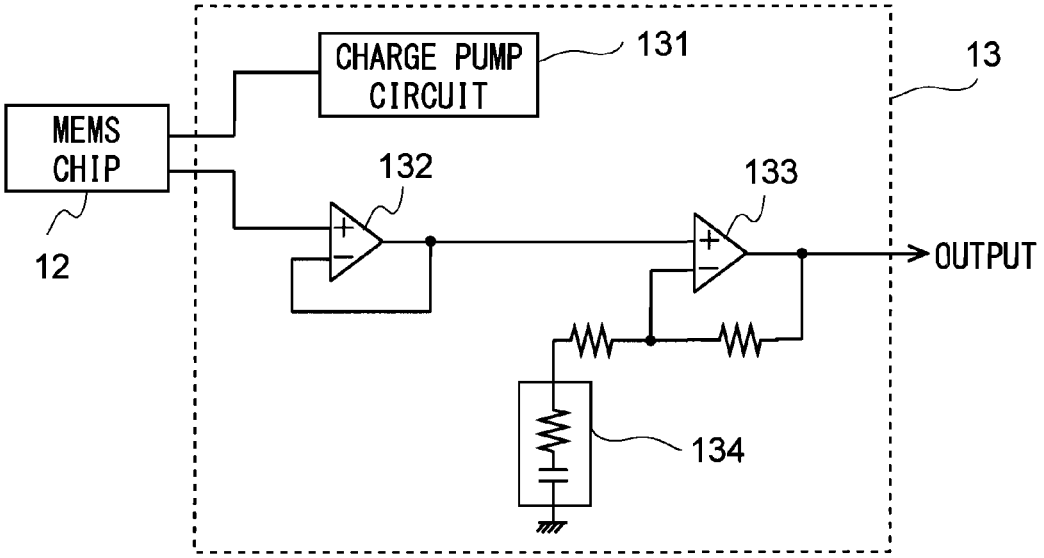
FIG. 4 is a diagram showing the circuit configuration of an ASIC included in the microphone unit of this embodiment.

As shown in FIG. 2, the ASIC 13 is arranged in the first sound introducing space 113 in the microphone unit 1. FIG. 4 is a diagram showing the circuit configuration of the ASIC 13 included in the microphone unit 1 of this embodiment. The ASIC 13 is an embodiment of an electric circuit unit of the present invention and is an integrated circuit for amplifying an electric signal, which is generated based on a change in the electrostatic capacitance in the MEMS chip 12, using a signal amplifying circuit 133. In this embodiment, a charge pump circuit 131 and an operational amplifier 132 are included so that a change in the electrostatic capacitance in the MEMS chip 12 can be precisely obtained. Further, a gain adjustment circuit 134 is included so that an amplification factor (gain) of the signal amplifying circuit 133 can be adjusted. An electric signal amplified by the ASIC 13 is, for example, outputted to and processed by a voice processing unit on an unillustrated mounting board, on which the microphone unit 1 is to be mounted.

With reference to FIG. 2, the circuit board 14 is a board, on which the MEMS chip 12 and the ASIC 13 are mounted. In this embodiment, the MEMS chip 12 and the ASIC 13 are both flip-chip mounted and electrically connected by a wiring pattern formed on the circuit board 14. Although the MEMS chip 12 and the ASIC 13 are flip-chip mounted in this embodiment, they may be mounted, for example, using wire bonding without being limited to this configuration.

Next, the operation of the microphone unit 1 is described.

Figure 5:
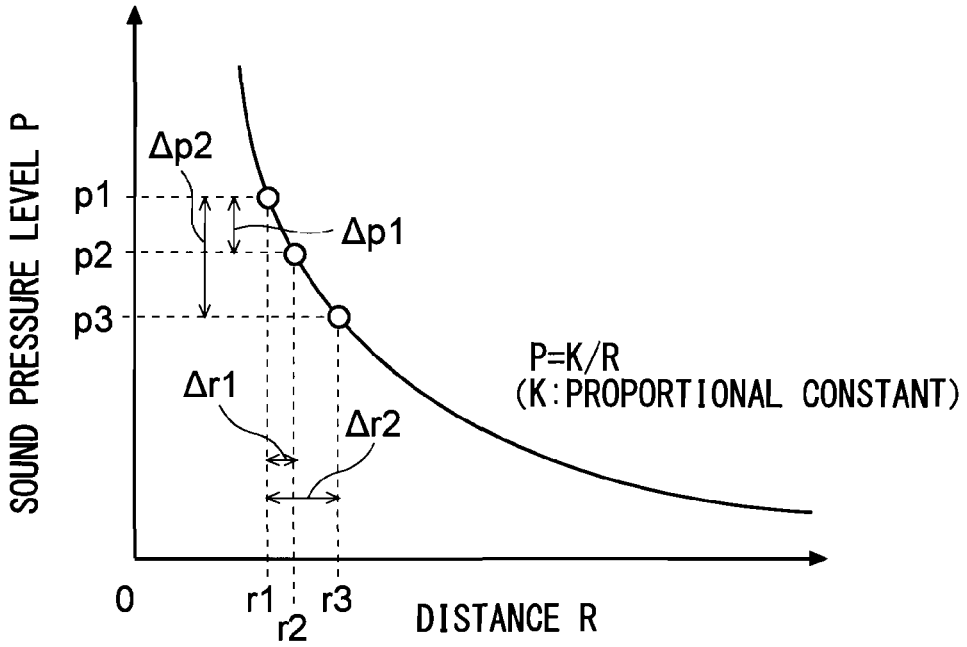
FIG. 5 is a graph chart showing a sound wave attenuation characteristic.

Prior to the description of the operation, a property of a sound wave is described with reference to FIG. 5. As shown in FIG. 5, a sound pressure of a sound wave (amplitude of a sound wave) is inversely proportional to a distance from a sound source. The sound pressure is suddenly attenuated at a position near the sound source, and is more moderately attenuated according as becoming more distance from the sound source.

For example, in the case of applying the microphone unit 1 to a cross-talking voice input device, a user's voice is generated near the microphone unit 1. Thus, the user's voice is largely attenuated between the first sound hole 111 and the second sound hole 112 and there is a large difference between a sound pressure incident on the upper surface 122*a* of the vibrating membrane 122 and that incident on the lower surface 122*b* of the vibrating membrane 122.

On the other hand, sound sources of noise components such as background noise are located at positions more distant from the microphone unit 1 as compared with the sound source of the user's voice. Thus, a sound pressure of noise is hardly attenuated between the first sound hole 111 and the second sound hole 112 and there is hardly any difference between a sound pressure incident on the upper surface 122*a* of the vibrating membrane 122 and that incident on the lower surface 122*b* of the vibrating membrane 122.

The vibrating membrane 122 of the microphone unit 1 vibrates due to a sound pressure difference of sound waves simultaneously incident on the first and second sound holes 111, 112. Since a sound pressure difference of noise incident on the upper and lower surfaces 122*a*, 122*b* of the vibrating membrane 122 from a distant place is very small as described above, the noise is canceled out by the vibrating membrane 122. On the contrary, since the sound pressure difference of the user's voice incident on the upper and lower surfaces 122*a*, 122*b* of the vibrating membrane 122 from a proximate position is large, the user's voice vibrates the vibrating membrane 122 without being canceled out.

From the above, the vibrating membrane 122 can be assumed to be vibrated only by the user's voice according to the microphone unit 1. Thus, an electric signal output from the ASIC 13 of the microphone unit 1 can be assumed as a signal having noise (background noise and so on) removed therefrom and representing only the user's voice. In other words, according to the microphone unit 1 of this embodiment, an electric signal having noise removed therefrom and representing only the user's voice can be obtained by a simple construction.

If the microphone unit 1 is constructed as in this embodiment, a sound pressure applied to the vibrating membrane 122 is a difference between sound pressures input from the two sound holes 111, 112. Thus, a sound pressure, which vibrates the vibrating membrane 122, is small and an extracted electric signal is likely to have a poor SNR. In this respect, the microphone unit 1 of this embodiment has a feature of improving the SNR. This is described below.

Figure 6:
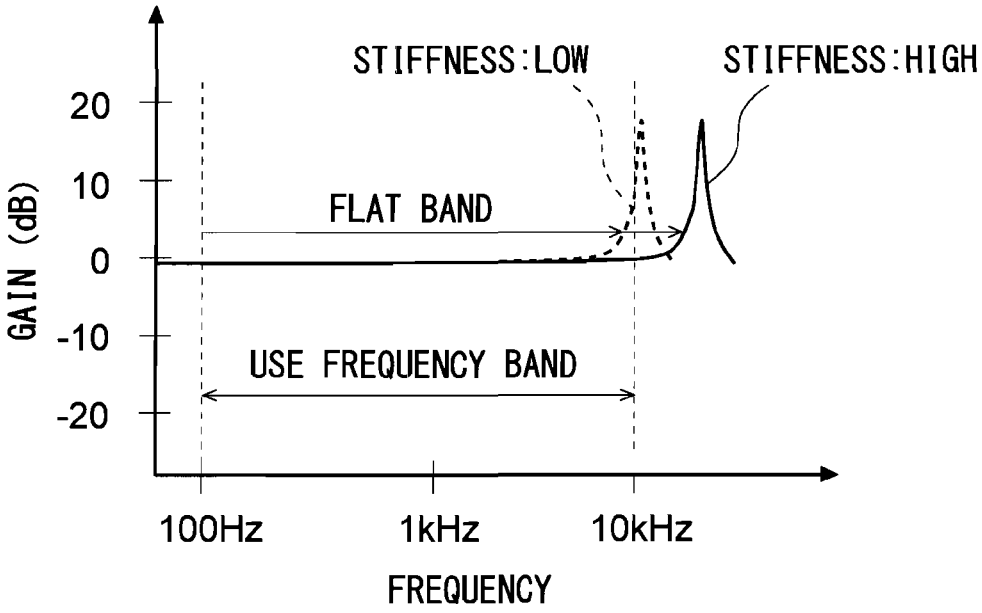
FIG. 6 is a graph chart showing a method for designing a vibrating membrane in a conventional microphone unit.

FIG. 6 is a graph chart showing a method for designing a vibrating membrane in a conventional microphone unit. As shown in FIG. 6, a resonance frequency of the vibrating membrane included in the microphone unit varies with the stiffness of the vibrating membrane and the resonance frequency of the vibrating membrane decreases if the vibrating membrane is so designed as to reduce the stiffness. Conversely, if the vibrating membrane is so designed as to increase the stiffness, the resonance frequency thereof increases.

Conventionally, upon designing the microphone unit, the vibrating membrane has been so designed that resonance of the vibrating membrane does not affect a frequency band, in which the microphone unit is used (use frequency band). Specifically, for a frequency characteristic of the vibrating membrane, the stiffness of the vibrating membrane has been so set that a gain hardly varies with frequency variation in the use frequency band of the microphone unit as shown in FIG. 6 (flat band). For example, if the use frequency band is 100 Hz to 10 kHz, the stiffness of the vibrating membrane has been set high so that the resonance frequency of the vibrating membrane is about 20 kHz.

Sensitivity of a microphone decreases if the stiffness of the vibrating membrane is set high to increase the resonance frequency of the vibrating membrane in this way. This has led to a problem that the SNR tends to be poor for the microphone unit 1 constructed such that the vibrating membrane 122 is vibrated due to a difference between the sound pressure on the upper surface 122*a* and that on the lower surface 122*b* of the vibrating membrane 122 as in this embodiment.

In the microphone unit 1, if a distance between the first and second sound holes 111, 112 is narrow, a differential pressure on the vibrating membrane 122 decreases (see Δp1 and Δp2 of FIG. 5). Thus, to improve the SNR of the microphone, the distance between the two sound holes 111, 112 needs to be large to a certain degree.

On the other hand, it is known from studies made by the present inventors thus far that the SNR of the microphone decreases due to an influence by a phase difference of a sound wave if the distance between the first and second sound holes 111, 112 is excessively increased (see, for example, Japanese Unexamined Patent Publication No. 2007-98486). From the above, the present inventors have concluded that the distance between the centers of the first and second sound holes 111, 112 is preferably set to not less than 4 mm and not more than 6 mm, more preferably about 5 mm. By this configuration, it is possible to obtain a microphone unit which can ensure a high SNR (e.g. 50 dB or higher).

In the microphone unit 1, it is necessary to ensure a predetermined cross-sectional area or larger (e.g. equivalent to a circular area with a diameter ϕ of about 0.5 mm) of a sound path to suppress deterioration of acoustic characteristics. Considering that the distance between the first and second sound holes 111, 112 is set to about 4 to 6 mm as described above, volumes of the first and second sound introducing spaces 113, 114 are large.

Figure 7:
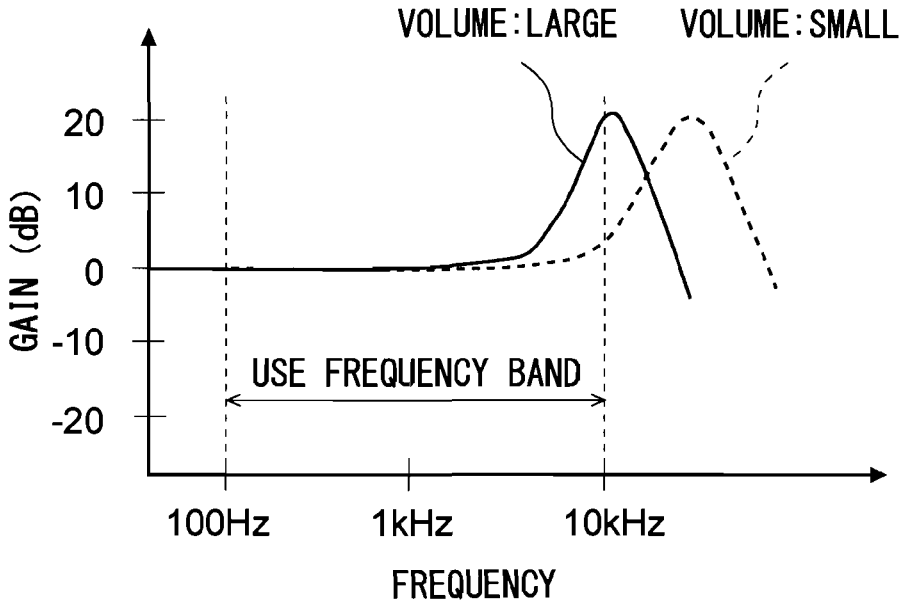
FIG. 7 is a graph chart showing a frequency characteristic of a sound introducing space.

FIG. 7 is a graph chart showing a frequency characteristic of a sound introducing space. As shown in FIG. 7, a resonance frequency of the sound introducing space decreases as the volume thereof increases while increasing as the volume thereof decreases. As described above, the microphone unit of this embodiment tends to have large volumes of the sound introducing spaces 113, 114 and the resonance frequencies of the sound introducing spaces 113, 114 tend to be lower as compared with the conventional microphone unit. Specifically, the resonance frequencies of the sound introducing spaces 113, 114 appear, for example, at about 10 kHz. The first and second sound introducing spaces 113, 114 are so designed that frequency characteristics thereof are substantially equal (i.e. the resonance frequencies thereof are also substantially equal). The frequency characteristics of the sound introducing spaces 113, 114 may not necessarily be substantially equal. However, if the frequency characteristics of the both are substantially equal as in this embodiment, it is convenient since a microphone unit with a high SNR can be easily obtained without using, for example, an acoustic resistance member or the like.

Figure 8:
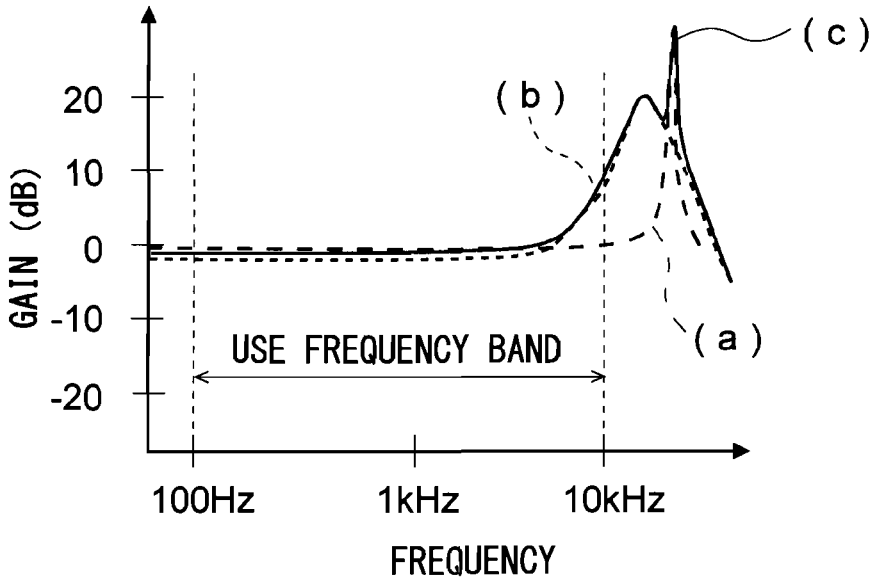
FIG. 8 is a graph chart showing a frequency characteristic of the microphone unit.

FIG. 8 is a graph chart showing a frequency characteristic of a microphone unit. In FIG. 8, (a) denotes a graph showing a frequency characteristic of a vibrating membrane, (b) denotes a graph showing a frequency characteristic of a sound introducing space, and (c) denotes a graph showing a frequency characteristic of the microphone unit. As shown in FIG. 8, the frequency characteristic of the microphone unit is a frequency characteristic equal to the one obtained by combining the frequency characteristic of the vibrating membrane and that of the sound introducing space.

In the microphone unit 1 of this embodiment, the volumes of the sound introducing spaces 113, 114 have to be large to a certain degree as described above. Thus, it is difficult to eliminate the influence of the resonance of the sound introducing spaces 113, 114 on the above use frequency band by setting the resonance frequencies of the sound introducing spaces 113, 114 to high. In view of this point, it becomes less meaningful to prevent the influence of the resonance of the vibrating membrane on the above use frequency band by setting the resonance frequency of the vibrating membrane 122 in a high frequency range (e.g. 20 kHz). Instead, improving sensitivity of the vibrating membrane 122 by making the resonance frequency of the vibrating membrane 122 closer to those of the sound introducing spaces 113, 114 is more advantageous for improving the SNR of the microphone unit 1.

The result of a study shows that the SNR of the microphone unit 1 of this embodiment becomes good, if a resonance frequency fd of the vibrating membrane 122 is set in the range of ±4 kHz from a resonance frequency f1 of the first sound introducing space 113 or a resonance frequency f2 of the second sound introducing space 114. This is described below with reference to FIGS. 9, 10 and 11. Note that the resonance frequency f1 of the first sound introducing space 113 and the resonance frequency f2 of the second sound introducing space 114 are set substantially equal in the microphone unit 1 as described above. Thus, unless particularly necessary, the following description is made with respect to the resonance frequency f1 of the first sound introducing space 113 as a representative.

Figure 9:
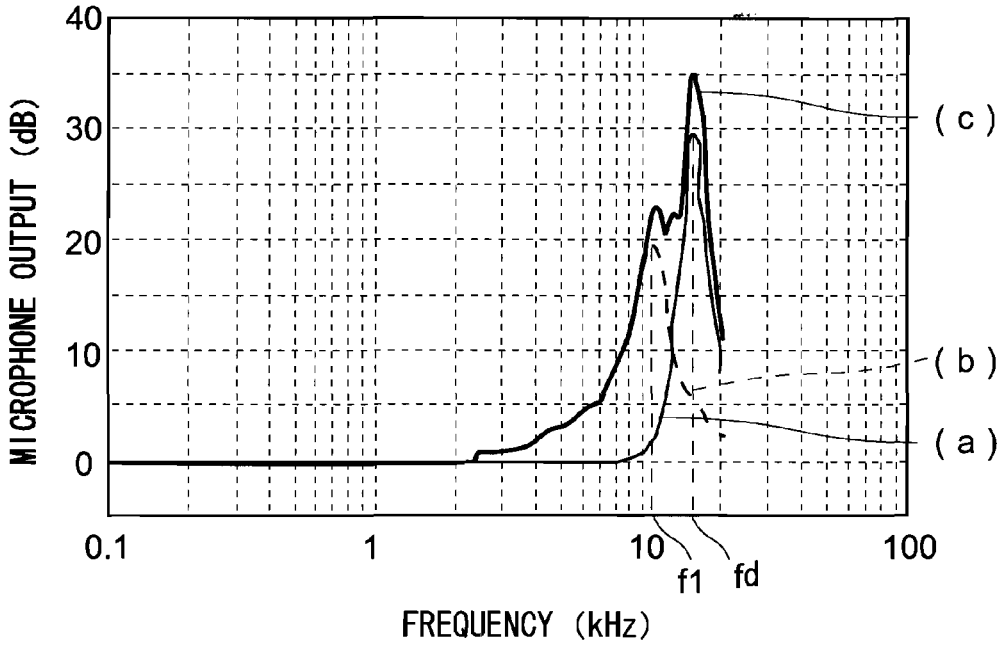
FIG. 9 is a graph chart showing a frequency characteristic when a resonance frequency fd of a vibrating membrane is set higher than a resonance frequency f1 of a first sound introducing space substantially by 4 kHz in the microphone unit of this embodiment.
Figure 10:
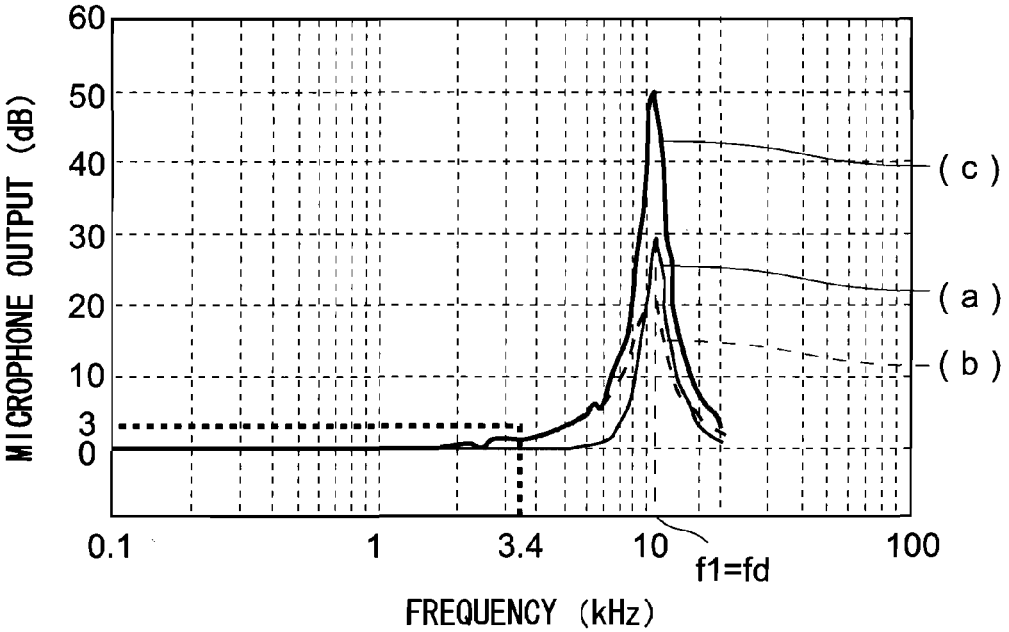
FIG. 10 is a graph chart showing a frequency characteristic when the resonance frequency fd of the vibrating membrane is set substantially equal to the resonance frequency f1 of the first sound introducing space in the microphone unit of this embodiment.
Figure 11:
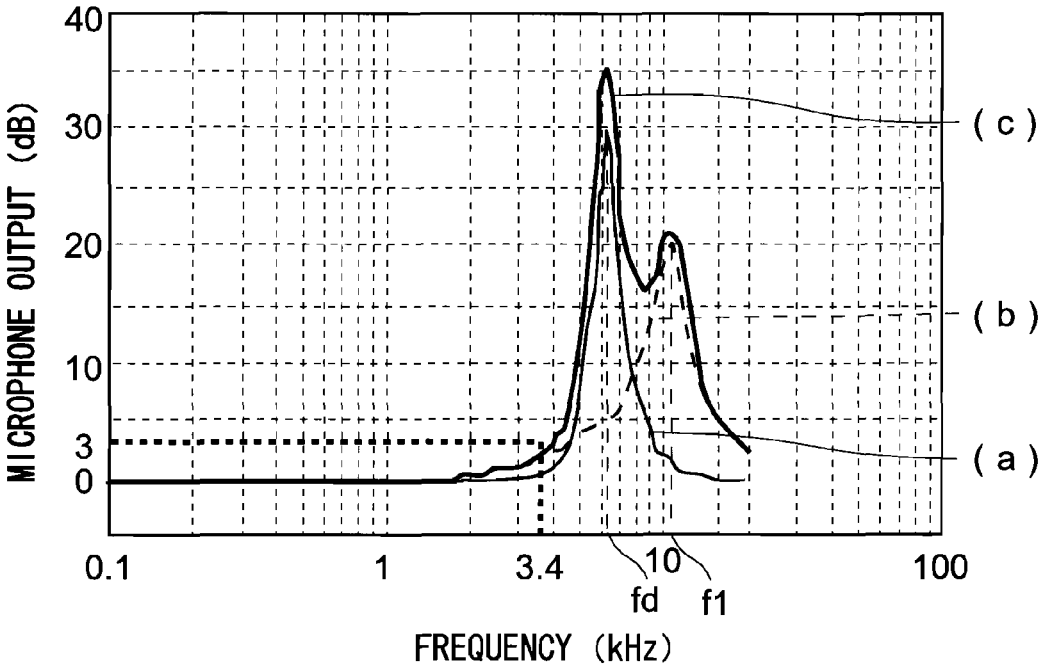
FIG. 11 is a graph chart showing a frequency characteristic when the resonance frequency fd of the vibrating membrane is set lower than the resonance frequency f1 of the first sound introducing space substantially by 4 kHz in the microphone unit of this embodiment.

FIG. 9 is a graph chart showing a frequency characteristic when the resonance frequency fd of the vibrating membrane 122 is set higher than the resonance frequency f1 of the first sound introducing space 113 substantially by 4 kHz in the microphone unit 1 of this embodiment. FIG. 10 is a graph chart showing a frequency characteristic when the resonance frequency fd of the vibrating membrane 122 is set substantially equal to the resonance frequency f1 of the first sound introducing space 113 in the microphone unit 1 of this embodiment. FIG. 11 is a graph chart showing a frequency characteristic when the resonance frequency fd of the vibrating membrane 122 is set lower than the resonance frequency f1 of the first sound introducing space 113 substantially by 4 kHz in the microphone unit 1 of this embodiment. In FIGS. 9 to 11, (a) shows a frequency characteristic of the vibrating membrane 122, (b) shows a frequency characteristic of the first sound introducing space 113 and (c) shows a frequency characteristic of the microphone unit 1.

Note that the resonance frequency f1 of the first sound introducing space 113 is preferably as high as possible to increase the SNR of the microphone unit 1. In view of this point, the resonance frequencies of the sound introducing spaces 113, 114 of the microphone unit 1 are in the neighborhood of 11 kHz (not less than 10 kHz and not more than 12 kHz) in FIGS. 9 to 11.

As shown in FIG. 9, a peak derived from the resonance frequency fd of the vibrating membrane 122 is sharp and a peak derived from the resonance frequency f1 of the first sound introducing space 113 is broad. Thus, the frequency characteristic of the microphone unit 1 at a lower frequency side is hardly affected even if the resonance frequency fd of the vibrating membrane 122 is brought to a frequency higher than the resonance frequency f1 of the first sound introducing space 113 substantially by 4 kHz.

Specifically, it can be understood in FIG. 9 that the frequency characteristic of the microphone unit 1 hardly varies in the neighborhood of 10 kHz despite the fact that sensitivity is increased by decreasing the resonance frequency fd of the vibrating membrane 122. In other words, it is possible to improve the sensitivity of the vibrating membrane 122 more than before while maintaining the characteristic of the microphone unit 1 in the use frequency band, for example, when an upper limit of a higher frequency side of the use frequency band in the microphone unit 1 is 10 kHz.

As described above, the resonance frequency of the vibrating membrane 122 needs not to be set high since the resonance frequencies of the sound introducing spaces 113, 114 cannot be set high in the microphone unit 1. Accordingly, the SNR is improved by decreasing the stiffness (that means a decrease in resonance frequency) and increasing the sensitivity of the vibrating membrane 122. The resonance frequency fd of the vibrating membrane 122 is better to be low in the sense of increasing the sensitivity of the vibrating membrane 122 to improve the SNR. However, if the resonance frequency fd of the vibrating membrane 122 is excessively reduced, the above flat band (for example, see FIG. 6) may become narrower to reduce the SNR. In other words, there is a lower limit in reducing the resonance frequency fd of the vibrating membrane 122.

With reference to FIG. 10, if the resonance frequency fd of the vibrating membrane 122 and the resonance frequency f1 of the first sound introducing space 113 are set substantially equal, the frequency characteristic of the microphone unit 1 starts being affected by a decrease in the resonance frequency fd of the vibrating membrane 122 after exceeding 7 kHz. If the upper limit of the use frequency band of the microphone unit 1 is 10 kHz, there is a certain degree of influence in the neighborhood of 10 kHz, but such a design is possible due to a balance with an SNR improvement effect resulting from an increase in the sensitivity of the vibrating membrane 122.

An upper limit of a voice band of the present mobile phones is 3.4 kHz. In this case, the sensitivity of the vibrating membrane 122 can be improved more than before while the characteristic of the microphone unit 1 in the use frequency band is maintained if the resonance frequency fd of the vibrating membrane 122 and the resonance frequency f1 of the first sound introducing space 113 are set substantially equal.

A result of a study on how much the resonance frequency fd of the vibrating membrane 122 should be reduced in view of the voice band of the present mobile phones is shown in FIG. 11. In the case of considering the present mobile phones, a frequency characteristic at 3.4 kHz, which is the upper limit of the used voice band, is required to be within ±3 dB for an output of 1 kHz. In this respect, it was found that the above requirement is satisfied even if the resonance frequency fd of the vibrating membrane 122 is reduced to a frequency about 4 kHz below the resonance frequency f1 of the first sound introducing space 113. In this case, the resonance frequency fd of the vibrating membrane 122 can be reduced to about 7 kHz and an improvement in the SNR resulting from an improvement in the sensitivity of the vibrating membrane 122 can be expected.

It can be said that, if the resonance frequency fd of the vibrating membrane 122 is in the range of ±4 kHz from the resonance frequency f1 of the first sound introducing space 113 (or the resonance frequency f2 of the second sound introducing space 114) as described above, an improvement of the SNR can be expected for the microphone unit 1 of this embodiment, which is applied to a voice input device.

Figure 12:
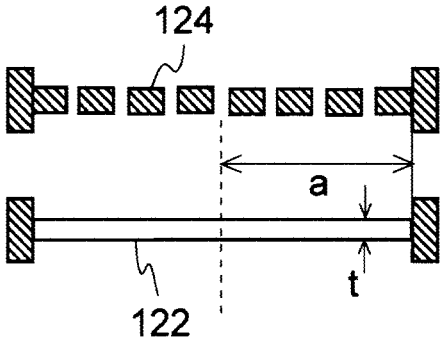
FIG. 12 is a diagram showing a model used to derive conditions in the case the vibrating membrane is composed of silicon in the microphone unit of this embodiment.

The vibrating membrane 122 of the microphone unit 1 of this embodiment can be, for example, made of silicon. However, a material of the vibrating membrane 122 is not limited to silicon. Preferred design conditions when the vibrating membrane 122 is made of silicon are described. Note that the vibrating membrane 122 is modeled as shown in FIG. 12 upon deriving the design conditions.

The resonance frequency fd (Hz) of the vibrating membrane 122 is expressed by the following equation (1) when Sm (N/m) denotes the stiffness of the vibrating membrane 122 and Mm (kg) denotes the mass of the vibrating membrane 122.

[Equation 1]

$$fd = \frac{1}{2\pi}\sqrt{\frac{Sm}{Mm}} \tag{1}$$

The stiffness Sm of the vibrating membrane 122 and the mass Mm of the vibrating membrane 122 are expressed as in the following equations (2) and (3) respectively (see non-patent literature 1). Here, E: Young's modulus (Pa) of the vibrating membrane 122, ρ: density (kb/m$^3$) of the vibrating membrane 122, ν: Poisson's ratio of the vibrating membrane 122, a: radius (m) of the vibrating membrane, t: thickness (m) of the vibrating membrane 122.

[Equation 2]

$$Mm = \frac{1}{5}\cdot\pi\cdot a^2\cdot\rho\cdot t \tag{2}$$

[Equation 3]

$$Sm = \frac{16\cdot\pi\cdot E\cdot t^3}{9\cdot a^2\cdot(1-\nu^2)} \tag{3}$$

Non-Patent Literature 1:

Jen-Yi Chen, Yu-Chun Hsul, Tamal Mukherjee, Gray K. Fedder, "MODELING AND SIMULATION OF A CONDENSER MICROPHONE", Proc. Transducer '07, LYON, FRANCE, vol. 1, pp. 1299-1302, 2007

The resonance frequency fd of the vibrating membrane 122 is expressed in the following equation (4) by substituting the equations (2) and (3) into the equation (1).

[Equation 4]

$$fd = \frac{2t}{3\pi a^2}\sqrt{\frac{5E}{\rho(1-\nu^2)}} \tag{4}$$

As described above, the resonance frequency fd of the vibrating membrane 122 is preferably ±4 kHz from the resonance frequency f1 of the first sound introducing space 113. If the preferred resonance frequency f1 of the first sound introducing space 113 is 11 kHz, the resonance frequency fd of the vibrating membrane 122 preferably satisfies the following equation (5).

[Equation 5]

$$7000 \leqq \frac{2t}{3\pi a^2}\sqrt{\frac{5E}{\rho(1-\nu^2)}} \leqq 15000 \tag{5}$$

The following equation (6) is obtained by substituting E=190 (Gpa), ν=0.27, ρ=2330 (kg/m$^3$) as material characteristics of silicon into the equation (5).

[Equation 6]

$$0.15 \leqq \frac{t}{a^2} \leqq 0.35 \quad (6)$$

In other words, if silicon is selected as the material of the vibrating membrane 122 in the microphone unit 1 of this embodiment, the high-performance microphone unit 1 capable of ensuring a high SNR can be obtained by setting the radius "a" and the thickness "t" of the vibrating membrane 122 so that the equation (6) is satisfied.

The embodiment illustrated above is an example and the microphone unit of the present invention is not limited to the construction of the embodiment illustrated above. Various changes may be made on the construction of the embodiment illustrated above without departing from the object of the present invention.

For example, in the embodiment illustrated above, the vibrating membrane 122 (diaphragm) is arranged in parallel to the surface 11*a* of the case 11 where the sound holes 111, 112 are formed. However, without being limited to this configuration, the diaphragm may not be parallel to the surface of the case where the sound holes are formed.

In the microphone unit 1 illustrated above, a so-called condenser microphone is employed as the construction of the microphone (corresponding to the MEMS chip 12) including the diaphragm. However, the present invention is also applicable to a microphone unit employing another construction other than the condenser microphone as the construction of the microphone including the diaphragm. For example, electrodynamic (dynamic), electromagnetic (magnetic), piezoelectric microphones and like may be cited as the construction other than the condenser microphone including the diaphragm.

Industrial Applicability

The microphone unit of the present invention is suitable for voice communication devices, such as mobile phones and transceivers, information processing systems, such as voice authentication systems, that utilize a technology for analyzing input voice, sound recording devices and the like.

Reference Numeral List

1 microphone unit
11 case
12 MEMS chip
13 ASIC (electric circuit unit)
111 first sound hole
112 second sound hole
113 first sound introducing space
114 second sound introducing space
122 vibrating membrane (diaphragm)
122*a* upper surface of vibrating membrane (first surface of diaphragm)
122*b* lower surface of vibrating membrane (second surface of diaphragm)

The invention claimed is:

1. A microphone unit, comprising:

a case; and a diaphragm arranged inside the case;

wherein:

the case includes a first sound introducing space that introduces a sound from outside of the case to a first surface of the diaphragm via a first sound hole and a second sound introducing space that introduces a sound from outside of the case to a second surface of the diaphragm, which is an opposite surface of the first surface of the diaphragm, via a second sound hole;

wherein the first and second sound holes are formed in the same surface; and a distance between the centers of the first and second sound holes is not less than 4 mm and not more than 6 mm; and a resonance frequency fd of the diaphragm fulfills formula below:

$$7000<fd<15000,$$

Where $$fd = \frac{2t}{3\pi a^2} * \sqrt{(5E)/(\rho(1-v^2))}$$

fd represents the resonance frequency (Hz) of the diaphragm;

α represents a radius (m) of the diaphragm;

ρ represents a density (kg/m3) of the diaphragm;

υ represents a Poisson's ratio of the diaphragm;

E represents a Young's modulus (Pa) of the diaphragm; and t represents a thickness (m) of the diaphragm.

2. The microphone unit according to claim 1, wherein the resonance frequencies of the first and second sound introducing spaces are substantially equal.

3. The microphone unit according to claim 1, wherein inside the case, an opening is formed through which two spaces communicate with each other, and in one of the two spaces, a microphone having the diaphragm is arranged so as to stop the opening such that the first and second sound introducing spaces are formed.

4. The microphone unit according to claim 1, wherein the diaphragm is formed of silicon, and the diaphragm fulfills formula below:

$$0.15<t/a^2<0.35.$$

* * * * *